US009246273B2

(12) United States Patent
Montet et al.

(10) Patent No.: US 9,246,273 B2
(45) Date of Patent: Jan. 26, 2016

(54) RAPID FIXING DEVICE FOR RAPID DISCONNECTION TWO-PART CONNECTOR

(71) Applicant: Amphenol-Air LB, Blagny (FR)

(72) Inventors: Davy Montet, Vendresse (FR); Gaspard Cayzac, Margut (FR)

(73) Assignee: Amphenol-Air LB, Blagny (FR)

( * ) Notice: Subject to any disclaimer, the term of this patent is extended or adjusted under 35 U.S.C. 154(b) by 120 days.

(21) Appl. No.: 14/245,421

(22) Filed: Apr. 4, 2014

(65) Prior Publication Data

US 2014/0302704 A1 Oct. 9, 2014

(30) Foreign Application Priority Data

Apr. 5, 2013 (FR) ..... 13 53094

(51) Int. Cl.

| | |
|---|---|
| ***H01R 39/00*** | (2006.01) |
| ***H01R 13/642*** | (2006.01) |
| ***H01R 13/627*** | (2006.01) |
| ***H01R 13/633*** | (2006.01) |
| ***H01R 13/629*** | (2006.01) |
| *H01R 13/645* | (2006.01) |

(52) U.S. Cl.

CPC ..... *H01R 13/642* (2013.01); *H01R 13/629* (2013.01); *H01R 13/6277* (2013.01); *H01R 13/633* (2013.01); *H01R 13/6453* (2013.01)

(58) Field of Classification Search

CPC ..... H01R 35/025; H01R 17/12
USPC ..... 439/15, 63, 74, 75, 82, 944, 319, 578
See application file for complete search history.

(56) References Cited

U.S. PATENT DOCUMENTS

| | | | | |
|---|---|---|---|---|
| 3,235,834 | A | 2/1966 | O'Keefe et al. | |
| 3,336,562 | A * | 8/1967 | McCormick | H01R 13/635 439/155 |
| 3,665,129 | A * | 5/1972 | Lancaster | H01R 24/58 200/51.07 |
| 3,671,922 | A | 6/1972 | Zerlin et al. | |
| 3,793,685 | A * | 2/1974 | Knecht | B63B 21/00 114/230.26 |
| 4,163,594 | A | 8/1979 | Aujla | |
| 5,609,498 | A | 3/1997 | Muzslay | |
| 7,326,090 | B2 | 2/2008 | Cayzac | |

FOREIGN PATENT DOCUMENTS

| | | |
|---|---|---|
| EP | 0996201 | 4/2000 |

OTHER PUBLICATIONS

French Search Report for French Patent Application No. FR 1353094 issued Feb. 21, 2014.

* cited by examiner

*Primary Examiner* — Phuongchi T Nguyen
(74) *Attorney, Agent, or Firm* — Meyertons, Hood, Kivlin, Kowert & Goetzel, P.C.; Eric B. Meyertons

(57) ABSTRACT

A removable fixing device includes a first elongated mating member, a second elongated mating member designed to be inserted in the first elongated mating member, and an elastic member adapted to lock the two elongated mating members axially relative to each other and retractable radially on insertion of the second elongated mating member into the first elongated mating member. One elongated mating member includes an actuator mobile axially relative to the elongated mating member between a first position in which the elastic member locks the two elongated mating members axially and a second position in which the actuator unlocks the elongated mating members by radial retraction of the elastic member.

16 Claims, 3 Drawing Sheets

RAPID FIXING DEVICE FOR RAPID DISCONNECTION TWO-PART CONNECTOR

PRIORITY CLAIM

This application claims priority to French Patent Application No. FR 1353094 filed Apr. 5, 2013.

BACKGROUND OF THE INVENTION

1. Field of the Invention

The invention relates to connection devices and specifically to connection devices for cables which include a two-part connector, made of two parts designed to be assembled on either side of a support wall, the cables passing through the wall.

2. Description of the Relevant Art

Connectors are conventionally employed for connecting electrical cables, but could serve to connect other types of cables, like optical cables.

These connectors can be used to connect a bundle of cables between the interior and the exterior of equipment delimited by the support wall, and can be used in vehicles, for example in aircraft, for the supply of power and exchange of data for onboard electrical or electronic units.

Connectors of this type generally include two matching connector parts that are assembled to each other, trapping a portion of the support wall between them.

In order to ensure that the connection of the cables is properly made, the connectors are often provided with polarizer means so that an operative person can assemble a connector part only to the associated connector part, and can assemble them in only one position relative to each other.

These polarizer means may also include means for fastening the two connector parts to each other, as in French patent application FR 2 814 967, for example.

In that document, the polarizers include a hexagonal head that is inserted into a hexagonal receiving cavity of one of the connector parts, and includes an elongated mating member provided with a polarizing shape protruding from this connector part. A fixing screw engages directly into the first polarizer element, aligned with it, the screw being guided by a second polarizer element having a complementary shape to the first polarizer element. An appropriate tool is necessary for fastening the screw, and the screwing operation may be time consuming. The device described necessitates handling at least three different parts: a first polarizer portion, a second polarizer portion, and a fixing screw.

French patent application FR 2 887 079 proposes to use a quarter-turn screw and to pre-assemble the quarter-turn screw into the second polarizer element.

Assembly must then proceed by trial and error to be sure that the correct movement has been executed in order for the quarter-turn screw to be properly locked. If the operative person is not used to manipulating this type of fastening means, he may not lock the quarter-turn screw correctly.

SUMMARY OF THE INVENTION

The invention proposes a fixing device with elongated mating members serving also as polarizers, which can be assembled very rapidly and intuitively, and which can be assembled and disassembled without using tools.

To this aim, the invention proposes a removable fixing device including a first elongated mating member, a second elongated mating member designed to be inserted in the first elongated mating member, and an elastic member adapted to lock the two elongated mating members axially relative to each other, the elastic member being configured to retract radially from its locking shape upon insertion of the second elongated mating member into the first elongated mating member. One elongated mating member is assembled to an actuator which can be moved axially relative to the elongated mating member, between a first position in which the elastic member holds the two elongated mating members axially locked together and a second position in which the actuator unlocks the elongated mating members from each other by causing a radial retraction of the elastic member.

In other words, the actuator is adapted to move axially between a first position in which, when the two elongated mating members are inserted into one another, the interaction between the actuator and the elastic member allows axial locking of the two elongated mating members by the elastic member and a second position in which, when the two elongated mating members are inserted into one another, the interaction between the actuator and the elastic member brings about radial retraction of the elastic member so as to unlock the second elongated mating member axially relative to the first elongated mating member. In an advantageous embodiment, the elastic member may be assembled to the one of the elongated mating member, and the actuator may be assembled to the other elongated mating member. In a preferred embodiment, when the second elongated mating member is inserted into the first elongated mating member, the actuator is so configured that pushing the actuator in the direction of the assembled elongated mating members displaces the actuator from the first locking position to the second unlocking position. This makes the unlocking easy even with oily or slippery hands, for the actuator may be moved by a plunger inserted in the elongated mating member.

Each elongated mating member may comprise a guiding body terminated at a front end by an assembling extremity end and terminated at a rear end by an enlarged stop head, the assembling extremity of the second elongated mating member being configured to be inserted axially into the assembling extremity of the first elongated mating member. Here, "front" elements and "rear" elements are meant to describe elements located along the elongated mating member respectively on the same side as the assembling extremity and on the same side as the enlarged head of the elongated mating member.

Preferably, the elastic member is assembled to one of the elongated mating members, and said elongated mating member comprises a polarizing shape allowing only one relative angular position of insertion of the second elongated mating member into the first elongated mating member, said polarizing shape being axially comprised between the elastic member and the head of the elongated mating member. In some embodiment, the elastic member can act as polarizing shape. In other embodiments, the polarizing shape is one piece with the elongated mating member, and is placed axially behind the elastic member. In this way, the polarizing shape cannot hinder the action of the actuator facing the elastic member.

In accordance with one particularly advantageous embodiment, the elastic member is configured to be retracted radially by compression into the second elongated mating member upon insertion of the end of the second elongated mating member into the first elongated mating member, and is configured thereafter to expand elastically so as to reach into the first elongated mating member, so as to lock the second elongated mating member axially relative to the first elongated mating member.

The elastic member may be an axially split ring retracting into a circumferential groove running around the second elongated mating member, the elastic member comprising a frustoconical surface facing the first elongated mating member and converging toward the first elongated mating member. The frustoconical surface can thus act as a ramp during the insertion into the first elongated mating member or while unlocking the removable fixing device by means of the actuator.

Here "radially retracting" the elastic member in the second elongated mating member means compressing the elastic member so as to reduce its overall radial size, sufficiently to unlock the second elongated mating member relative to the first elongated mating member. The elastic member still may project above an exterior surface of the second elongated mating member in the retracted position.

In an advantageous embodiment, one of the elongated mating members includes a plunger inserted axially in the elongated mating member from an enlarged stop head of the elongated mating member, and an axial movement of the actuator can be driven by manual action on the plunger. The plunger may be configured to allow only axial movements of the plunger, or may be configured to allow both axial translations and rotations. Preferably, the plunger, the head of the elongated mating member, and the actuator are so configured that in at least one angular position of the plunger, a mere axial pressing action by hand on the plunger displaces the actuator from its first, locking position, to the second, unlocking position. In some embodiments, the pressing action displaces the actuator to the second position whenever the plunger is pressed. In some other embodiments, the pressing action displaces the actuator to the second position for some angular initial positions of the plunger. By angular position or rotation of the plunger, is meant a rotation around the axis of the elongated mating member to which the plunger is assembled.

In accordance with one preferred embodiment, the actuator is configured to compress the elastic ring radially when axial pressure is exerted on the plunger. The actuator may include a tube portion, which may be concentric with the elastic ring. In accordance with various embodiments, the elastic member may be retracted by exerting a pressure tending to close up or on the contrary tending to enlarge the ring. The retraction of the elastic element may on the contrary occur when pressure on the ring or pressure on the elastic member is released. In accordance with one advantageous embodiment, the plunger includes a return member configured to urge the axial actuator toward the rear of the elongated mating member into which it is inserted. By movement toward the rear of the first elongated mating member means here a movement in the direction moving from the assembling extremity toward the enlarged head of the first elongated mating member.

In accordance with another embodiment, the plunger can be configured to slide toward inside the head of the first elongated mating member along at least one surface of the plunger or one surface of the elongated mating member, said surface having a texture or having raised patterns configured to limit non intentional axial forward movement of the plunger relative to the head. To return the plunger to the locked configuration prior to a new operation of assembling the two elongated mating members, it is then necessary to pull the plunger to extract it again from the head of the first elongated mating member. For example, a peripheral surface of the plunger may be provided with circumferential raised patterns defined by a saw tooth radial section. A first predefined force value must be exerted to insert the plunger, and a second predefined force value must be exerted to extract it, the second force value being greater than the first, for example, or the two force values being substantially equal.

The plunger may include an actuator having a shape of a hollow tube, the inside diameter of which is equal to one of the diameters of the frustoconical surface of the ring, other than the maximum diameter of the frustoconical surface.

In accordance with a preferred embodiment, the first elongated mating member is pierced by a substantially cylindrical first portion or guide portion, having a first inside diameter followed by a second portion or expansion portion having an inside diameter greater than the first diameter. In accordance with this embodiment, the second elongated mating member axially traverses the first or guide portion and axially traverses at least a portion of the expansion portion.

In accordance with this embodiment, the plunger axially traverses at least a portion of the expansion portion and the actuator has an outside diameter substantially equal to the diameter of the expansion portion. The axial movement of the plunger can therefore be guided by a portion of the actuator bearing radially on the expansion portion of the first elongated mating member. The actuator is configured so that it can move axially relative to the expansion portion. In accordance with a different embodiment, the plunger may be pushed in until it axially traverses the whole of the expansion portion. In the pushed in position, the plunger therefore reduces the inside diameter for radial bearing engagement available inside the whole of the extension portion. In accordance with other embodiments, the actuator is mobile relative to the expansion portion but cannot be pushed in so that it passes through the whole of the expansion portion. Here "outside diameter of the actuator" means the diameter of the smallest circle inside which may be inscribed the portion of the actuator acting on the elastic member, i.e. the outside diameter of the tube when the actuator is a tube. In accordance with another alternative embodiment in which the actuator includes a group of axial pins, the outside diameter of the actuator could be the diameter of a circle circumscribing the pins. The expansion portion and the guide portion are preferably linked by a radial shoulder surface configured to retain the elastic member when the latter is expanded inside the first elongated mating member. In accordance with a different embodiment, the actuator may include an end the outside diameter of which is less than the diameter of the expansion portion, for example a portion with a diameter less than or equal to the inside diameter of the guide portion, so that the actuator is able not only to traverse the expansion portion but also to be inserted into a portion of the guide portion. In accordance with this embodiment, the plunger may axially traverse the expansion portion and at least an axial portion of the guide portion. In accordance with other, simpler embodiments, the actuator has an outside diameter enabling it to be guided by the expansion portion without enabling it to penetrate into the guide portion.

The maximum outside diameter of the unstressed elastic ring or the maximum outside diameter of the elastic member or possibly group of elastic members, preferably has a diameter greater than or equal to, the inside diameter of the expansion portion. In accordance with a preferred embodiment, the interior guide portion of the first elongated mating member is traversed by a recess forming an axial groove and the assembling extremity of the second elongated mating member includes an upstanding axial key adapted to be inserted axially into the axial groove of the first elongated mating member. In accordance with another possible embodiment, the guide portion of the first elongated mating member includes an upstanding axial key and the assembling extremity of the second elongated mating member includes a recessed axial groove angularly aligned with the slot of an elastic ring serving to lock the two elongated mating members together.

In accordance with one advantageous embodiment, the inside diameter of the actuator is substantially equal to the diameter of the guide portion. In accordance with a different embodiment, the inside diameter of the actuator may be less than the diameter of the guide portion. "Inside diameter of the actuator"s means the diameter of the largest circle that can be inscribed inside the areas of the actuator that come into contact with the elastic member or members of the second elongated mating member. When the actuator is a tube, the inside diameter of the actuator is the inside diameter of the tube.

The plunger may include a hollow metal tube portion onto which is moulded an end portion out of polymer material, the end portion comprising one or more portions of an axial lateral skirt overlapping axially a portion of the tube and defining a cylindrical space between the tube and the skirt.

The plunger can then include a coil spring inserted between the tube and the skirt. Actually, the plunger may comprise any elastic returning means configured to bring back the plunger to the position relative to the head corresponding to the unlocking position of the actuator.

According to an advantageous embodiment, the free end of the first elongated mating member comprises a radial retaining rim protruding radially toward the inside of the head so as to limit locally the opening section of a cylindrical housing in which the plunger is inserted. The cylindrical housing may a delimited by a circular cylindrical section, or may be delimited by any generation section, such as a square or a hexagonal section. The radial retaining rim may be a continuous rim, or may comprise one or more separate protruding bulges which globally reduce the available maximum section allowed for the insertion of the plunger.

The skirt preferably comprises a plurality of separate portions extending each axially, at least two portions being configured to serve as elastic retaining means and to retain the plunger inserted axially inside the head of the first elongated mating member. To this aim, the elastic retaining means may include radial raised patterns configured to be inserted behind a radial retaining rim provided at an axial end of the head of the first elongated mating member.

In accordance with another embodiment, the plunger may comprise a one-piece part including a first hollow tube portion defining the actuator and including at least one axial portion provided with a circumferential groove receiving an elastic split ring positioned radially outside the hollow tube portion. Preferably, the elastic split ring is positioned radially outside the axial portion, the diameter of which may be larger than, or equal to, the outside diameter of the tube portion. In this embodiment, the radial retaining rim may comprise separate bulges or may be a continuous rim, and the outside diameter of the elastic split ring in unstressed state is then larger than the minimum insertion diameter allowed by the retaining rim. In embodiments where the retaining rim is circular, the outside diameter of the ring is larger than the inside diameter of the rim. The plunger may comprise other elastic retaining means than axial elastic tabs or circumferential elastic ring, for example may comprise compressible radial bulges disposed circumferentially around and the plunger.

In accordance with one preferred embodiment, the axial portion is defined on a second hollow tube portion encircling the first hollow tube portion. A spring can therefore be accommodated within a radial space defined between the two hollow tube portions. In accordance with another embodiment, the axial portion carrying the retaining split ring may be part of the same tube as the tube portion defining the actuator, the tube outside diameter varying between the actuator portion and the axial portion. A spring may then be placed around a portion of the tube having the smallest or having an intermediate outside diameter, and the spring may be retained axially against a shoulder defined by an area of increasing outside diameter of the tube. The retaining groove is then provided in the vicinity of the shoulder, on the outside of the portion of the tube with the largest diameter. In accordance with one embodiment, the variation in outside diameter of the tube may be obtained by varying the radial thickness of the tube. According to another embodiment, the variation in outside diameter of the tube may be obtained with a tube of constant radial thickness.

The head of the first elongated mating member may be opened on it axial end on an inside cylindrical volume, said volume having a third diameter greater than the diameter of the expansion portion, and being limited toward the rear of the elongated mating member by a retaining rim, which restrains the diameter of a rear side of the volume to a minimum diameter which is less than the third diameter but greater than the diameter of the expansion portion. The cylindrical volume at the end is configured to accommodate the elastic retaining means of the plunger.

In accordance with one advantageous embodiment, the plunger has a shape adapted to be inserted in a counterpart shape provided on the head of the elongated mating member when the plunger is in a first angular position relative to the elongated mating member, the shape being adapted to prevent the plunger from being pushed into the elongated mating member in at least one second angular position of the plunger.

The invention also proposes a connection system for connecting cables arriving on either side of a support plate. The connection system includes a device as described above, including a first connector portion pierced by an orifice terminating in a polygonal countersink of complementary shape to an enlarged head of the second elongated mating member, including a second connector portion pierced by an orifice terminating in a polygonal countersink of complementary shape to an enlarged head of the first elongated mating member, the two connector portions being adapted to be fastened together axially by the fixing device. The connection system preferably includes at least two fixing devices as described above. In accordance with one preferred embodiment, the assembling extremity of the second elongated mating member and the assembling extremity of the first elongated mating member include complementary polarizing patterns allowing only one angular position of insertion of the second elongated mating member in the first elongated mating member. The device can then serve as an assembly device functioning also as a polarizer for assembling a connection system.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
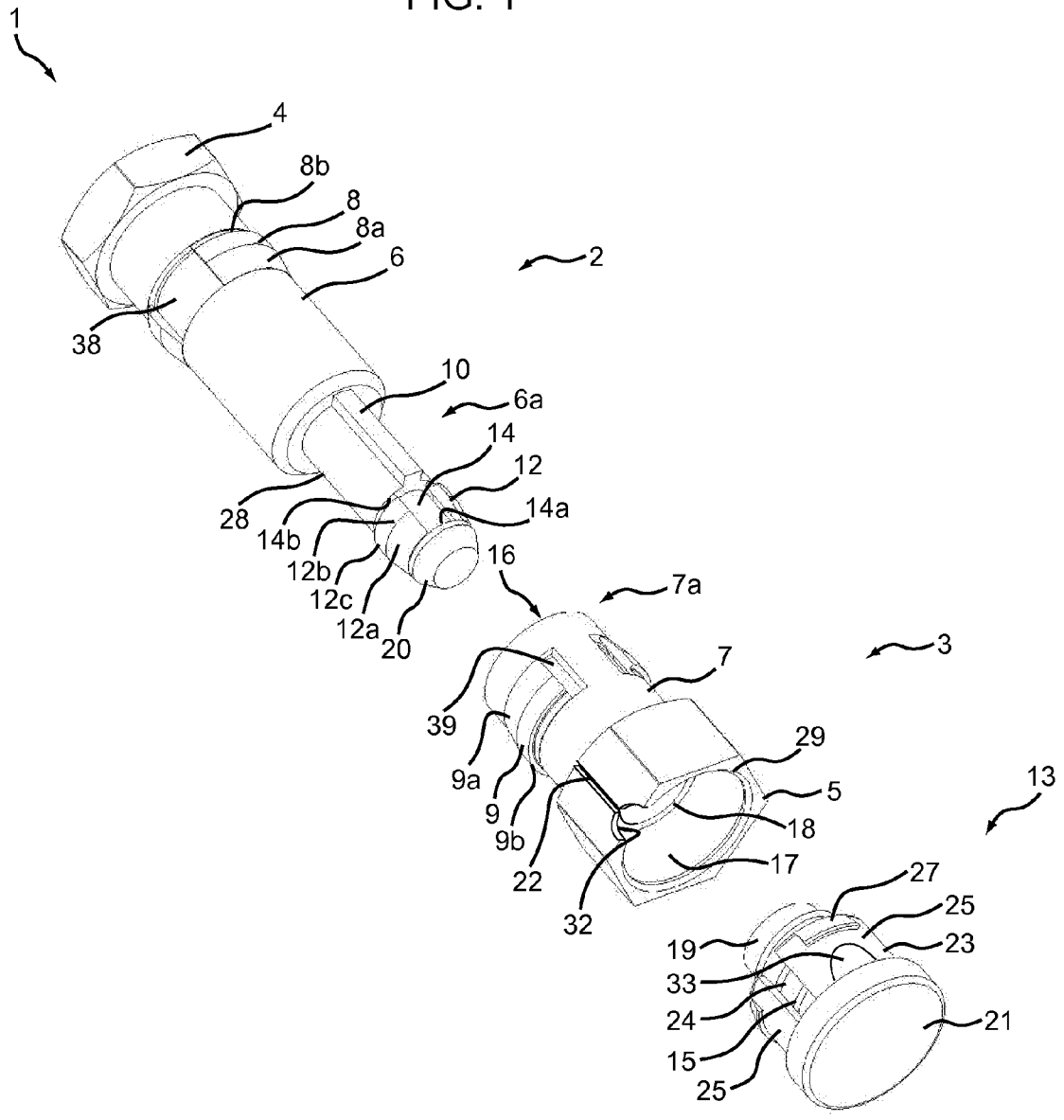
FIG. 1 is an exploded perspective view of a fixing and polarizer device in accordance with the invention.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

Figure 2:
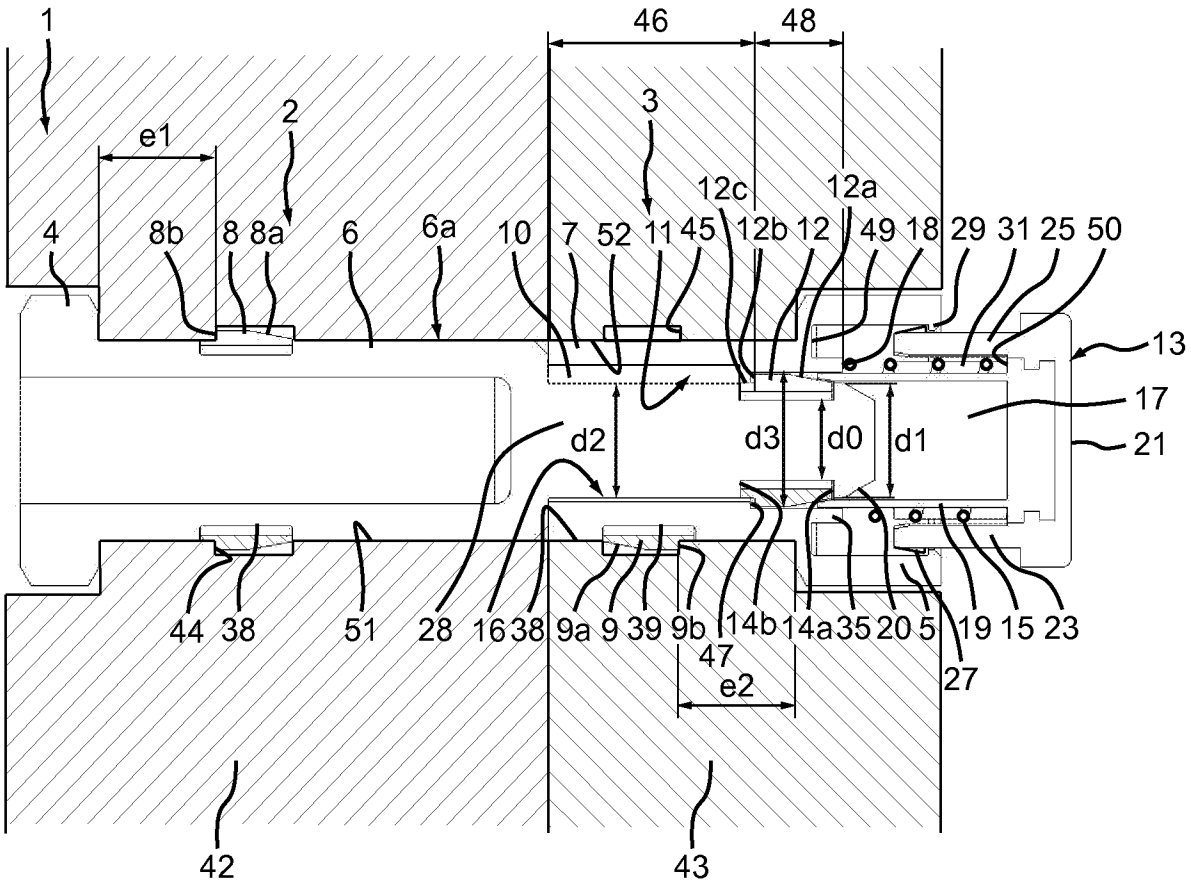
FIG. 2 is a sectional view of a component of a fixing and polarizer device in accordance with the invention.

As shown in FIG. 1, the fixing system 1 in accordance with the invention includes a male second elongated mating member 2 and a female first elongated mating member 3. The male elongated mating member 2 includes an axial key 10 protruding from the globally cylindrical surface 28 of the assembling extremity 6*a* of the second elongated mating member. The axial key 10 is complementary to an internal axial groove 11 (not visible on FIG. 1, but visible on FIG. 2) of the first elongated mating member. Each of the elongated mating members 2, 3 includes a substantially cylindrical guide body 6, 7, respectively, and a stop head 4, 5, respectively, the contour of which is of polygonal shape, for example of hexagonal shape. More generally, the head has a shape adapted to prevent rotation of the elongated mating member about its axis xx' when the stop head 4, 5 is inserted in a complementary housing of a connector portion (not shown), this shape allowing a plurality of distinct positions of the head with in the housing that is dedicated to it. The outside diameter of each guide body 6, 7 substantially corresponds to the inside diameter of an assembly bore 51, 52, respectively, visible only in FIG. 2, provided in one of the two connector portions to be assembled.

Throughout the description the expression axial direction refers to the direction xx' common to the longitudinal axes of the two elongated mating members, which is also the direction of insertion of the second elongated mating member 2 into the first elongated mating member 3. Throughout the description, the rear of an elongated mating member is the side located at the same end as the stop head of the elongated mating member and the front of the elongated mating member corresponds to the end axially opposite to the stop head.

The second elongated mating member 2 includes an assembling extremity 6*a* in line with the guide body 6 and carrying the axial key 10. The guide body 7 of the first elongated mating member comprises an assembling extremity 7*a* that may in some cases extend along the whole guide body 7 and which is hollow, so as to be able to receive within it the assembling extremity 6*a* of the second elongated mating member.

The guide body 6 of the second elongated mating member includes a circumferential groove 38 in which is inserted an elastic split ring 8 having a frustoconical portion 8*a* with an external diameter diminishing toward the front of the elongated mating member and having on its rear side a radial portion 8*b* adapted to bear axially against a shoulder provided inside the connector when the elongated mating member is inserted into the connector and when the split ring 8 expands elastically therein.

In a similar manner, the first elongated mating member 3 includes a circumferential groove 39 in which is accommodated a split ring 9 having at the front a frustoconical portion 9*a* and at the rear a radial bearing zone 9*b*.

The assembling extremity 6*a* of the second elongated mating member includes a front portion 20 that is chamfered so as to facilitate relative centering of the two elongated mating members 2, 3 during the insertion of the second elongated mating member 2 into the first elongated mating member 3. The chamfered portion may be replaced by a conical portion or by some other profile inscribed within a cone portion, for example three or four ribs merging on the axis xx' and inscribed within a frustoconical portion.

Behind the chamfered portion 20, the assembling extremity 6*a* includes a circumferential groove 14 into which is inserted an axially split ring 12 having, like the split rings 8 and 9, a frustoconical portion 12*a* at the front and a radial bearing zone 12*b* at the rear. The circumferential grooves 38, 39 and 14 may extend over the whole of the circumference of the elongated mating member or may be interrupted (as in the case of the groove 39 illustrated) at the level of the opening of the corresponding split ring The interruption of the circumferential groove 39 running externally around the first elongated mating member makes it possible to provide inside the first elongated mating member the space necessary for the axial groove 11.

The heads 4 and 5 may each be labelled with an angular marker, illustrated here in the form of an orientation slot 22 visible on the head 5. This angular marker makes it possible to identify visually the angular position of the elongated mating member when the latter is in position in the connector.

The first elongated mating member 3 is axially and completely traversed by a substantially cylindrical bore, the front portion of which constitutes a housing 16 in which the assembling extremity 6*a* of the second elongated mating member may be inserted, and the rear end of which forms a housing 17 in which is axially inserted a plunger 13, the plunger providing a radial pushing surface at the axial rear end 21 of the plunger. The housing 16 includes at the front of the elongated mating member a first guide-polarizer portion 46 connected by a radial shoulder 47 with an expansion portion 48 having a diameter greater than the diameter of the guide portion, the expansion portion 48 being located to the rear of the guide portion 46.

The radial depth of the groove 14, the inside and outside diameters of the ring 12, are chosen so that the ring 12 can be retracted radially into the groove 17 sufficiently to insert the assembly portion 6*a* of the second elongated mating member 2 axially into the housing 16 of the first elongated mating member 3, over a distance sufficient for the ring 12 to travel axially beyond the guide portion 46 and to expand elastically inside the expansion portion 48. The outside diameter of the unstressed ring 12 being greater than the minimum diameter of the annular locking shoulder 48, the ring 12 is then locked axially inside the first elongated mating member 3. The circumferential groove 14 is delimited toward the front of the elongated mating member 2 by a radial portion 14*a* and at the rear by a radial portion 14*b*. The outside diameter of the front radial portion 14*a* is greater than the inside diameter of the ring 12 when the latter has expanded elastically inside the expansion portion 48. On relaxing, the ring 12 therefore also locks the second elongated mating member axially relative to the first elongated mating member. The outside diameter of the rear radial portion 14 is preferably greater than the inside diameter of the ring 12 in a state in which it is not stressed elastically so as to be able to push the ring 12 axially inside the housing 16 of the first elongated mating member. The outside diameters of the radial portions 14*a* and 14*b* may be equal or the outside diameter of the front portion 14*a* may be less than that of the rear portion 14*b*.

The plunger 13 includes a shaped portion 33 creating a pattern protruding in the axial direction. This shaped portion is complementary with a portion 32 of complementary shape provided on the head 5 of the first elongated mating member. The shaped portion and the portion of complementary shape are adapted to enable greater axial movement of the plunger inside the head 5 when the shaped portion and the portion of complementary shape are facing each other than when the shaped portion and the portion of complementary shape are angularly offset relative to each other. The upstanding shaped portion may of course be provided on the head 5 and face a recessed portion of complementary shape on the plunger 13.

The plunger 13 includes an axial actuator, here in the form of a hollow tube 19, which in the assembled position is coaxial with the assembling extremity 7*a* of the second elongated mating member 2, and which, is also, coaxial with the frustoconical portion 12*a* of the ring 12. In the present embodiment the hollow tube is made of metal but it could equally be made from a polymer material, for example. The axial actuator is configured so as to come to bear axially on the frustoconical portion 12*a* of the assembling ring 12 when axial pressure is exerted on the plunger, for example at the level of the radial surface of the axial end 21 of the plunger, the ring 12 being expanded elastically inside the expansion portion 48. The frustoconical portion 12*a* of the ring 12 acts as a ramp and the axial force of the actuator 19 is converted at least partly to a radial compression force on the ring 12. In this way, when the plunger 13 is pushed in, the ring 12 is retracted radially and it becomes possible to disengage the second elongated mating member 2 from the first elongated mating member 3.

The plunger 13 includes a return spring 15, here located around the tube 19, the diameter of the spring corresponding to the diameter of a radial shoulder zone 18 provided inside the first elongated mating member 3, for example inside the head 5 of the first elongated mating member 3.

The spring may face the radial shoulder area 18 or bear on the latter.

The plunger 13 is surrounded by three axial elastic tabs 25, each carrying at an axial end a retaining lug 27 oriented radially outwards, the retaining lug being configured to be inserted axially beyond a retaining rim 29 locally reducing the diameter of the exit from the housing 17 receiving the plunger 13. Each elastic tab 25 includes an axial portion in the form of a tongue forming an angular portion of a cylindrical shell, the tongues being aligned circumferentially so as to form a cylindrical skirt 23 with axial openings 24. The skirt 23 surrounds the spring 15 which is therefore radially maintained between the tube 19 and the skirt 23, which define a guide housing 31 for the spring.

The axial length of the tube 19, the clips 23 and the axial length of the spring 15 are chosen in order to ensure that when the spring 15 is at its maximum allowed length by the elastic tabs 25, the tube 19 is positioned axially in front of the assembling ring 12, i.e. the tube 19 does not exert any axial force on the ring, or exerts an axial force which is lass than the force necessary to retract the ring 12. The tube 19 can for example be in pressure-limited contact with the ring to limit the axial overall size of the device or, in another embodiment the tube 19 may be separated axially from the ring in order to limit the risk of the tube interacting accidentally with the ring 12.

In FIG. 2, the fixing device from FIG. 1 is shown in section, so as to better show how the fixing device functions. FIG. 2 shows some elements common to FIG. 1, the same elements being designated by the same references.

It should be noted that in FIG. 1 the device is represented in an exploded disassembled mode, the plunger 13 being extracted from the head 5 of the first elongated mating member, although the device is designed to be delivered with the plunger clipped inside the head, the plunger remaining clipped in all subsequent modes of functioning of the device.

In FIG. 2, on the other hand, the fixing device is shown in an assembled and locked mode. Thus the second elongated mating member 2 is inserted in a bore 51 of a first connector portion 42, and the second elongated mating member is retained within the bore 51 by means of the retaining ring 8, the rear radial face 8*b* of the retaining ring 8 coming to bear axially on an interior radial shoulder 44 of the bore 51. The first elongated mating member 3 is inserted into a bore 52 of a second connector portion 43, in which it is retained by the ring 9, the rear radial surface 9*b* of which comes to bear axially on an interior radial shoulder 45 of the bore 52.

The axial thickness of the first connector portion traversed by the second elongated mating member here equals substantially a cumulative axial length of the guide body 6 of the second elongated mating member and of at least a portion of the stop head 4 of the second elongated mating member. The axial thickness of the second connector portion 43 traversed by the first elongated mating member substantially corresponds to a cumulative axial length of the guide body 7 of the first elongated mating member and of the axial thickness of the head 5 of the first elongated mating member. In this way, the assembling extremity 7*a* of the second elongated mating member projects beyond the first connector portion 42 when the first and second portions of the connector are separated and the housing 16 of the first elongated mating member 3 receiving this assembling extremity 7*a* is flush with the surface of the second portion 43 of the connector, thereby facilitating centering of the second elongated mating member relative to the first elongated mating member.

Other embodiments may of course be envisaged in which the lengths of the guide bodies 6 and 7 of the first and second elongated mating members do not correspond to the respective thicknesses of the connector portions in which they are inserted.

As already mentioned, the central axial bore 16 of the first elongated mating member 3 includes a guide-polarizer first axial portion 46 having a first diameter d2, and including an interior axial guide groove 11 adapted to receive the axial key 10 of the assembling extremity of the second elongated mating member.

This guide-polarizer portion 46 is axially next to an annular radial locking shoulder 47, which is itself followed by a substantially cylindrical expansion portion 48 having a diameter d3 greater than the diameter of the guide portion.

In the locked assembled position shown in FIG. 2, the assembling ring 12, after being inserted into the first elongated mating member, and after having passed through the whole axial length of the guide portion 46, assembling ring expands elastically and occupies a diameter which value is the smaller of the following two values: unstressed diameter of the ring 12, and diameter of the expansion portion 48.

In some embodiments in which, as in FIG. 2, the diameter d2 of the guide portion is strictly less than the diameter d3 of the expansion portion, the locking shoulder 47 may be limited to a radial surface joining the diameters d2 and d3. Variant embodiments may equally be envisaged, in which the diameter d2 is greater than or equal to the diameter d3, a border between the guide portion 46 and the expansion portion 48 then being delimited by a ring of material of the first elongated mating member protruding radially inside the housing 16 within the elongated mating member.

The diameter d0 of the circumferential groove 14 of the second elongated mating member 2 in which the ring 12 is accommodated, as well as the angular width of the slot opening the ring 12, are such that, by elastic deformation, the external diameter of ring 12 can be reduced to a diameter less than or equal to the minimum diameter of the shoulder 47. The diameter of the shoulder 47 may in some embodiments, correspond to the diameter d2, as illustrated in FIG. 2.

A diameter d1 of the front end of the second elongated mating member is defined as the maximum diameter of the surface 14*a* limiting the circumferential groove 14 on its front side, in which the ring 12 is accommodated. This diameter d1 is chosen to be greater than the inside diameter of the ring 12 when the latter is in the expanded position in the expansion portion 48. To prevent the ring 12 from being lost during pre-assembly of the fixing device, the diameter d1 is also greater than the inside diameter of the ring 12 in its unstressed state.

During insertion of the second elongated mating member into the first, the elastic ring 12 retracts elastically, either as soon as it enters the guide portion 46, or on passing beyond a radial constriction preceding the locking shoulder 47. The ring then expands inside the expansion portion 48 and thereafter prevents axial movement of the second elongated mating member relative to the first, being braced between the shoulder 47 and the front face 14*a* of the groove 14. In this locked state of the device, the tube 19 is in front of the assembling ring 12, possibly in contact with the frustoconical portion 12*a* of the ring but preferably without exerting any force on this portion 12*a*. Variant embodiments may be envisaged in which, in the locked position, the tube 19 would already be exerting a prestressing force on the ring 12, but the outside diameter of the ring 12 obtained in this way must then remain sufficient to lock the ring at the level of the shoulder 47.

Variant embodiments may be envisaged, in which the tube 19 is not directly in contact with the ring 12, in other words is located in front of the ring 12. The spring 15 exerts on the plunger 13, a return force urging the tube toward the rear of the first elongated mating member, which tends to move the tube 19 away from the ring 12. To this end, the spring 15 is braced between the bearing shoulder 18 of the first elongated mating member, and a radial bearing surface 50 of the plunger 13, ending axially on its rear side, the space delimited between the elastic tabs 25 and the tube 19. The outside diameter of the tube 19 is substantially equal to the diameter of the expansion portion 48, so that the expansion portion acts as a guide to centre the movement of the tube 19 when the tube is actuated to unlock the device.

To unlock the device, an operative person exerts, relative to the second connector portion 43 in which the first elongated mating member 3 is inserted, a pressure on the plunger 13, moving the tube 19 axially toward the rear of the second elongated mating member 2 and exerting a pressure on the frustoconical portion 12*a* of the ring 12, which then acts as a ramp converting the axial force into a radial force leading to an elastic reduction of the diameter of the ring 12.

The ring 12 is then able to pass beyond the shoulder 47 and the second elongated mating member 2 can be disengaged from the first elongated mating member 3. In order to facilitate slanted sliding of the tube 19 on the frustoconical portion 12*a* of ring 12 leading to retraction of the ring, the interior end of the tube 19 may be chamfered so that its interior corner fits the angle of the frustoconical portion 12*a* of the ring 12 in its position inside the expansion portion 48.

The dimensions of the unstressed ring 12 may be chosen so that the diameter of the unstressed ring is slightly greater than the diameter of the expansion portion 48. In accordance with another variant embodiment, the inside diameter of the expansion portion 48 may be greater than or equal to the outside diameter of the unstressed ring 12.

As FIG. 2 shows, the ring 12 may comprise, behind its radial zone 12*b*, a cylindrical portion 12*c* having a diameter less than the maximum diameter of the ring. When the fixing device is locked, the outside diameter of this cylindrical portion can come to bear radially against a zone of smaller section preceding the shoulder 47. Depending on the diameter difference between the maximum diameter of the ring and the diameter of cylindrical portion 12*c*, the diameter of the ring in the locked position may be imposed either by a radial contact at the level of a zone of maximum diameter of the ring, located between the frustoconical portion 12*a* and the radial shoulder 12*b*, or by a radial contact at the level of the portion 12*c*.

The cylindrical portion 12*c* can facilitate an axial transition displacement of the ring 12 from one side of the constriction zone to the other side of the constriction zone, both at the time of assembling and at the time of disassembling the device.

In some embodiments, the diameter d2 corresponds to the inside diameter of the guide portion 46 of the first elongated mating member 3 and also substantially corresponds to the outside diameter of the assembling extremity 6*a* of the second bush. This diameter d2 may be greater than the minimum diameter of the shoulder radial surface 47. In such embodiments, the ring 12 may be locked axially by an annular portion protruding inside the first elongated mating member, located ahead of the shoulder surface 47 relative to this first elongated mating member.

In this variant embodiment, it is possible to envisage designing an axial key 10 protruding from an inner surface of the first elongated mating member, and digging a corresponding axial groove into an inside portion of the guide-polarizer portion 46 of the second elongated mating member.

In some embodiments, the diameter of the assembling extremity 6*a* may be less then the inside diameter of the guide portion 46.

In the event of frequent assembly and disassembly of the device, the inside protruding annular portion may nevertheless be subject to early wear and the device may lose its efficacy more rapidly than in embodiments where the diameter d2 of the guide-polarizer portion 46 is less than the diameter d3 of the expansion portion 48.

The fixing device may be used as follows: the second elongated mating member 2 is introduced into a bore 51 of a first connector portion 42. The bore 51 includes a polygonal housing having a shape complementary to that of the head 4 of the second elongated mating member in order to prevent rotation of the second elongated mating member in the connector, as well as allowing a plurality of angular assembly positions of the second elongated mating member 2 within the first connector portion 42. The ring 8, the outside, unstressed diameter of which is greater than the diameter of the bore 51 of the first connector portion 42, is deformed by radial compression and then, once it has passed beyond a radial shoulder 44 inside the bore 51, expands and therefore locks the second elongated mating member 2 within the first portion 42 of the connector. In a similar manner, the first elongated mating member 3 is inserted into a dedicated bore 52 of the second connector portion 43, in an angular position such that, once the two connector portions 42 and 43 have been assembled, the respective angular positions of the axial key 10 of the second elongated mating member and the interior guide groove 11 of the first elongated mating member enable engagement of the axial key 10 in the interior groove 11.

The first elongated mating member 3 is locked axially inside the second connector portion 43 by means of the elastic ring 9, once the latter has expanded after passing axially beyond a radial shoulder 45 inside the bore 52. When the two portions 42 and 43 of the connector are moved toward each other, equipped each one with an elongated mating members 2 or 3, the assembling extremity 6*a* of the second elongated mating member is inserted axially in the guide-polarizer portion 46 of the first elongated mating member 3. If an error has occurred in the matching of the two connector portions, the angular position of the key 10 does not correspond to the angular position of the interior groove 11. With a single geometry of a pair of elongated mating members 2 and 3, it is possible to define six different matching configurations for an assembly device inserted in polygonal housings of the connector. The connector generally being assembled by at least two assembly devices disposed in a symmetrical manner with respect to the centre of the connector (where the bundles of cables are joined), such a connector provides thirty six possible combinations of different combinations of angular positions of the pair of polarizer assembly devices.

Let e1 denote the distance between the base of the head 4 of the second elongated mating member 2 and the radial bearing zone 8*b* of the ring 8. If this distance is equal to the distance e2 between the base of the head 5 of the first elongated mating member and the radial bearing zone 9*b* of the first elongated mating member 3, the number of non confusable possible assembling positions is further multiplied by two. Namely, for some connection configurations, the second elongated mating member can be inserted in a second connector portion 43 instead of the first connector portion, and the first elongated mating member can be inserted in a first connection portion 42.

Once the second elongated mating member has been inserted to the maximum insertion distance into the first elongated mating member, the ring 12 expands radially after passing beyond the shoulder 47 and opposes axial withdrawal of the second elongated mating member from the first elongated mating member. In this configuration, the plunger 13 protrudes axially out of the second connector portion 43. To disassemble the first connection portion 42 from the second connection portion 43, an operative person may push on the plunger 13 so as to move the tube 19 against the frustoconical portion 12*a* of the ring 12 and so to exert a radial compression force on the ring 12 to make the outside diameter of the ring 12 less than the minimum diameter of the shoulder 47. It then becomes possible to move the two connector portions apart, the elongated mating members 2 and 3 no longer being locked by the ring 12.

In embodiments where the first elongated mating member 3 is provided with a shaped portion 33 and a portion 32 of complementary shape, the operative person must first turn the end of the plunger 13 to bring the shaped portion 33 to face the portion 32 of complementary shape in order to allow a sufficient axial mobility of the plunger 13. The axial height of the shaped portion 33 is typically chosen so that, when this shaped portion is bearing on a zone of the head 5 other than the portion 32 of complementary shape, even if the tube 19 is in contact with the ring 12, the outside diameter of the ring 12 remains greater than the minimum diameter of the shoulder 47. The plunger may thus be secured against accidental unlocking by placing it in an appropriate angular position.

In the embodiment illustrated on FIG. 2, to ensure both correct guiding of the tube 19 and a sufficient axial mobility of the plunger 13, the expansion portion 48 of the first elongated mating member 3 extends further than the guide body 7 into the head 5 of the first elongated mating member. To this aim, an interior cylindrical extension rim 35 defines an axial extension of the expansion portion 48. When the plunger 13 is pushed in, the extension rim 35 gets inserted in a position which is radially between the elastic tabs 25 of the plunger and the actuator tube 19. At the end of the travel of the plunger, the elastic tabs 25 abut axially on a radial surface 49 surrounding the extension rim 35.

In embodiments without the shaped portion 33 and complementary shape system, or in case that after assembly the shaped portion 33 has not been moved away from the portion 32 of complementary shape, the return spring 15 nevertheless retains the plunger 13 in its position corresponding to the locked configuration of the device.

In accordance with the embodiment shown, the tube 19 may be a drop forged metal tube, for example, a tube closed at one end with a plastic head overmolded onto a closed end of the tube, the plastic head including axial elastic tabs 25 and covering the closed end of the metal tube so as to provide a radial pushing surface at the axial end 21 of the plunger. This configuration ensures good stiffness and good dimensional stability of the plunger 13 including the actuator 19. Variant embodiments may be envisaged in which the axial actuator would consist of one or more elements, not comprising a tube. In some embodiments, one may replace the tube 19 with a series of pins bearing simultaneously on the ring 2 at different points of its circumference.

Figure 3:
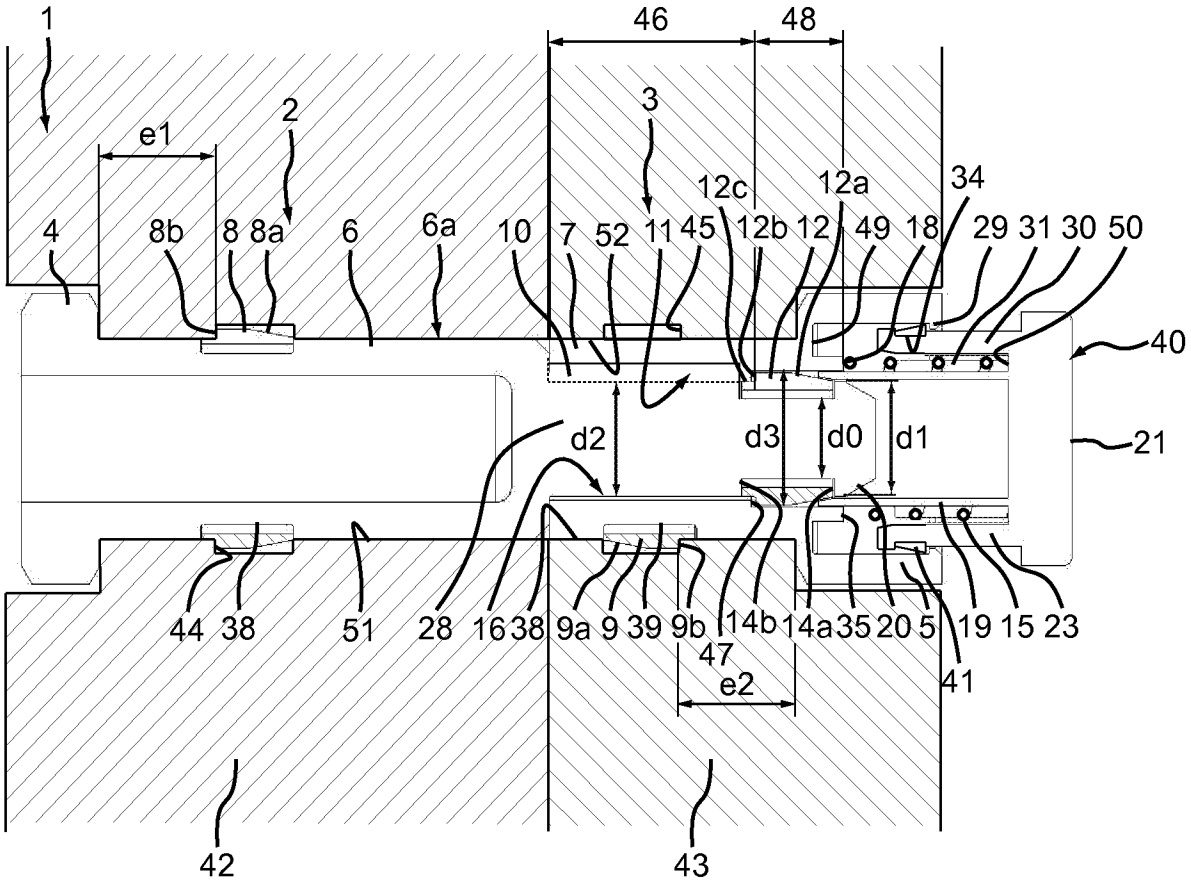
FIG. 3 is a sectional view of a component of another fixing and polarizer device in accordance with the invention.

FIG. 3 shows another fixing and polarizer device in accordance with the invention, in which the plunger 13 is made in a different manner. In this version, the tube 19 serving as the axial actuator is in one piece with the rear axial ends 21 of the plunger and includes an axial skirt 30 surrounding the tube 19. The axial skirt 30, fabricated in one piece with the tube 19, here replaces the axial skirt 23 from FIG. 2, formed by the elastic tabs 25. The spring 15 is retained radially between the tube 19 and the skirt 30. The axial skirt 30 forms a cylindrical circumferential portion that extends continuously around the central tube 19 of the plunger 40. The plunger 40 is retained inside the head 5 of the first elongated mating member by a split ring 41 encircling the axial end of the skirt 30. The ring 41 is inserted in a retaining groove 34 of the skirt 30. In its elastically unstressed position, the ring forms a radial raised pattern protruding from the radially exterior surface of the skirt 30. The depth of the groove 34 and the radial thickness of the ring 41 are such that the ring can be retracted in the groove 34 when the plunger 40 is inserted axially inside the head 5 of the first elongated mating member. The head 5 of the first elongated mating member comprises a retaining rim 29 protruding radially inwards toward the axis of the elongated mating member, said retaining rim causing a local restriction of the inside diameter of a cylindrical bore penetrating the rear side of the head. The outside diameter of the ring 41 is greater than or equal to the inside diameter of the retaining rim 29 of the plunger. The one-piece plunger 40 may be made of metal. It may equally be made of polymer materials, for example thermosetting polymer materials.

Once the plunger 40 has been inserted in the head 5 of the first elongated mating member, the plunger 40 is retained axially inside the elongated mating member by the ring 41. On remains within the scope of the invention if the outside cylindrical skirt 30 includes one or more axial apertures. An advantage of this one-piece configuration of the plunger is to ensure improved retention of the plunger 40 within the second elongated mating member and to prevent an accidental loss of the plunger.

The two connector portions 42 and 43 are very simple and quick to assemble, since this is done simply by compressing the two matching connectors one against the other, insisting on the cable engagement zones, and then pressing by hand the heads 4 and 5 of the fixing device 1. Disengagement of the connector may also be very fast, without requiring additional tools. Disengagement may be obtained by simply pressing the plunger whilst pulling the two connector portions apart (in embodiments where the plunger is not provided with a shaped portion and a portion of complementary shape imposing a particular angular position of the plunger to actuate the latter). Otherwise, disengagement may be obtained by turning the plunger to position the shaped portion 33 and the portion 32 of complementary shape face-to-face, then by pushing the plunger and pulling the two connector portions apart.

In order to facilitate separation of the two connector portions 42 and 43 when the connector includes a plurality of fixing devices 1, the hollow portion 32 of complementary shape may be designed wider (in the circumferential direction) than the shaped portion 33, so as to allow some rotation of the plunger in its unlocking axial position. The plunger 13 and the head 5 may each comprise a circumferentially extending retaining shape, the two retaining shape being configured to engage into one another when the plunger is rotated once the locking axial position is reached. In this way, the plunger 13 can be retained in its locking position, freeing the fingers of the operative person so that he can easily handle the other fixing devices and bring them to the unlocked position, and then easily pull the two connector portions 42 and 43 apart. More generally speaking, the head of the first elongated mating member and the plunger may each comprise complementary shapes configured to be able to lock the plunger relative to the head in a position corresponding to the unlocking position of the actuator. Advantageously, the shapes are configured so that they can be engaged or disengaged by rotating the plunger relative to the head. Other types of complementary shapes are possible, such as notched, "saw like" profiles on the outside of the plunger and on the inside of the head.

Thanks to its simple structure, the device is compact, for example it can have a length between 15 mm and 50 mm, preferably between 20 mm and 40 mm, and a diameter of the guide portions of the elongated mating members of between 4 mm and 10 mm. The rings 8, 9 and specially the ring 12 may be made from polymer material, for example polyetheretherketone (PEEK), so that their radial elastic return force procures good axial locking of each elongated mating member in its connector portion and of the second elongated mating member in the first elongated mating member. In this way also, the force to be exerted on the plunger in order to retract the ring 12 is nevertheless moderate and can be exerted by the pressure of a single finger of the operative person disassembling the connector. The axial force that the rings 8 and 9 are able to resist once locked in their respective connector portion is preferably greater than the axial force necessary to insert the end of the second elongated mating member into the first far enough to lock the two elongated mating member together. In this way, when assembling the connector, the operative person does not need to bother about the position of the elongated mating members or to press on the ends of the elongated mating members, provided that the latter are correctly matched, because they come pre-mounted in the connector, in order to provide the polarizer function. He just presses the two connector portions together. It is only at the time of disassembly that a handling of the first elongated mating member is necessary. The angle of the frustoconical portion of the rings 8, 9, 12 relative to the axis xx' of the elongated mating members may advantageously be comprised between 6 degrees and 15 degrees and preferably between 8 degrees and 12 degrees. The guide bodies of the elongated mating members are preferably made of metal, but could equally be made of polymer material, for example of a thermosetting polymer in order to guarantee good dimensional accuracy of the mating.

The invention is not limited to the embodiments described and may comprise many other embodiments.

The return spring 15 could be shorter and could be inserted axially between the ends of the elastic tabs 25—or between the skirt 30 of the plunger—and a substantially radial bearing surface 49 inside the head 5 of the first elongated mating member 3, which instead of being located at the end 18 of the expansion portion 48 of the first elongated mating member would be axially ahead of that end.

The ring 12 could be devoid of a rear cylindrical portion 12*c*. There may be no frustoconical front surface 12*a* on the ring 12 may, and there may be instead two or more surfaces forming a ramp on the inside of the end of the actuator 19 of the first elongated mating member, which may then have frustoconical surfaces getting wider toward the second elongated mating member. The ring 12 may then be defined in a radial plane by a rectangular section or some other section such as a round section.

The ring 12 could be replaced by one or more elastic members pertaining to the second elongated mating member and having a shape other than an annular shape, for example a plurality of elastic tabs extending axially from the second elongated mating member with harpoon shaped ends the tabs being configured to expand by bending radially, in order to retain the second elongated mating member within the first elongated mating member. These elastic members may have on a ramp on their front side a ramp surface and may be radially larger toward the rear of the second elongated mating member. The tabs may be linked in rotation with respect to the second elongated mating member, for example they may be in one piece with the end of the second elongated mating member if the latter is made of polymer material. The tabs need not all be the same width/radial height and need not being regularly distributed around the second elongated mating member. If they differ in size or distribution, they may then serve as polarizer elements for imposing the orientation of the second elongated mating member relative to the first elongated mating member.

Some embodiments may comprise an elastic ring 12, the size of which is that of an unlocked expanded state when the ring is elastically unstressed For example a ring when unstressed might come to bear on the outer circumference of the expansion portion, and the actuator might be configured to cause a radial compression of the ring in order to lock the two elongated mating members one relative to the other. In this case, the plunger does not include any return spring acting toward the exterior of the elongated mating member. On the contrary, such a plunger may include raised patterns or radial lugs making it possible to lock the plunger axially inside the elongated mating member until an external action is exerted to withdraw it from the elongated mating member.

The exterior surface 28 of the assembling extremity 6*a* could be different from a circular cylinder modified locally by a guide recess or by a raised pattern 10: the exterior surface 28 could be an extruded shape of any cross section, for example a cylinder with a polygonal cross section, this cross section being of complementary shape to a polygonal cylindrical bore of the guide portion 46 of the first elongated mating member.

Some embodiments may comprise an elastic ring that the actuator would not close up by compressing it, but that the actuator would instead enlarge when interacting with it. To this end an unlocking member could be inserted into the slot of the elastic ring, so as to increase the inside diameter of the elastic ring and expand the ring into a circumferential groove external to the elastic ring.

Polarizer shapes other than a key 10 on the male elongated mating member and other than an interior groove 11 on the female elongated mating member may be envisaged, for example an upstanding key on the female elongated mating member and a recessed groove on the male elongated mating member.

A tube shaped actuator can be designed to interact with an elastic element other than an elastic ring, for example the actuator can interact with a group of axial elastic tabs.

The polarizer shaped portion 10 of the assembling extremity 6*a* of the second elongated mating member is preferably positioned behind the ring 12, so as not to interfere with the action of the unlocking member 19 on the ring 12.

The device described may be used to assemble elements other than connectors; it may then not include polygonal heads 4 and 5 and/or not include polarizer members 10 and 11 of complementary shape.

In this case, the device may not either include exterior rings 8 and 9.

The fixing device according to the invention enables a quasi-instantaneous assembly and also enables a very fast disassembly of two connector portions, with using specific tools. The fixing device can at the same time provide a polarizer function, thereby limiting the number of parts to be produced and managed in order to manufacture the connector.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A removable fixing device comprising:

a first elongated mating member, a second elongated mating member designed to be inserted into the first elongated mating member, and an elastic member adapted to lock the two elongated mating members axially relative to each other, the elastic member being configured to retract radially from its locking shape when the second elongated mating member is inserted into the first elongated mating member, wherein an actuator is assembled to one elongated mating member, and said actuator can be moved axially relative to said elongated mating member, between a first position in which the elastic member may freely expand to its locking size, and a second position in which the actuator is able to cause a radial retraction of the elastic member so as to unlock the elongated mating members from each other;

wherein the one elongated mating member comprises a plunger; wherein the plunger comprises an actuator in the form of a hollow tube, wherein the first elongated mating member is pierced by a substantially cylindrical first or guide portion having a first inside diameter followed by a second or expansion portion having an inside diameter greater than the first diameter and wherein the plunger axially traverses the expansion portion and the actuator has an outside diameter substantially equal to the diameter of the expansion portion; and wherein an axial movement of the actuator is driven by the plunger.

2. The device according to claim 1, wherein the elastic member is configured to be retracted radially into the second elongated mating member by a radial compression force, upon insertion of the end of the second elongated mating member in the first elongated mating member and is configured to expand elastically thereafter inside the first elongated mating member so as to lock the second elongated mating member axially relative to the first elongated mating member.

3. The device according to claim 1, wherein the plunger is inserted axially in the elongated mating member from an enlarged stop head of the elongated mating member and wherein the axial movement of the actuator can be driven by manual action on the plunger.

4. The device according claim 1, wherein the inside diameter of the actuator is substantially equal to the diameter of the guide portion.

5. The device according to claim 1, wherein the plunger is provided with an axially protruding shaped portion adapted to be inserted in a portion of complementary shape provided on the head of the elongated mating member when the plunger in a first angular position relative to the elongated mating member, the shape being adapted to prevent the plunger from being pushed into the elongated mating member in at least one second angular position of the plunger.

6. The device according to claim 1, wherein the elastic member is an axially split ring configured to be retracted into a circumferential groove running around the second elongated mating member, the elastic member comprising a frustoconical surface facing the first elongated mating member and converging toward the first elongated mating member.

7. The device according to claim 6, wherein the hollow tube has an inside diameter which is equal to at least one diameter of the frustoconical surface of the ring other than the maximum diameter of the frustoconical surface.

8. The device according to claim 7, wherein the plunger comprises a one-piece part including a hollow tube portion defining the actuator and including at least one axial portion provided with a circumferential groove receiving a retaining elastic ring positioned radially outside the hollow tube portion.

9. A connection system for connecting cables arriving on either side of a support plate, comprising:

a fixing device comprising:

a first elongated mating member, a second elongated mating member designed to be inserted into the first elongated mating member, and an elastic member adapted to lock the two elongated mating members axially relative to each other, the elastic member being configured to retract radially from its locking shape when the second elongated mating member is inserted into the first elongated mating member, wherein an actuator is assembled to one elongated mating member, and said actuator can be moved axially relative to said elongated mating member, between a first position in which the elastic member may freely expand to its locking size, and a second position in which the actuator is able to cause a radial retraction of the elastic member so as to unlock the elongated mating members from each other;

wherein the one elongated mating member comprises a plunger, wherein the plunger comprises an actuator in the form of a hollow tube, wherein the first elongated mating member is pierced by a substantially cylindrical first or guide portion having a first inside diameter followed by a second or expansion portion having an inside diameter greater than the first diameter and wherein the plunger axially traverses the expansion portion and the actuator has an outside diameter substantially equal to the diameter of the expansion portion; and wherein an axial movement of the actuator is driven by the plunger;

a first connector portion pierced by an orifice terminating in a polygonal countersink of complementary shape to an enlarged head of the second elongated mating member;

a second connector portion pierced by an orifice terminating in a polygonal countersink of complementary shape to an enlarged head of the first elongated mating member, wherein the two connector portions are adapted to be fastened together axially by the fixing device.

10. The connection system according to claim 9, wherein the elastic member is configured to be retracted radially into the second elongated mating member by a radial compression force, upon insertion of the end of the second elongated mating member in the first elongated mating member and is configured to expand elastically thereafter inside the first elongated mating member so as to lock the second elongated mating member axially relative to the first elongated mating member.

11. The connection system according to claim 9, wherein the plunger is inserted axially in the elongated mating member from an enlarged stop head of the elongated mating member and the axial movement of the actuator can be driven by manual action on the plunger.

12. The connection system according claim 9, wherein the inside diameter of the actuator is substantially equal to the diameter of the guide portion.

13. The connection system according to claim 9, wherein the plunger is provided with an axially protruding shaped portion adapted to be inserted in a portion of complementary shape provided on the head of the elongated mating member when the plunger in a first angular position relative to the elongated mating member, the shape being adapted to prevent the plunger from being pushed into the elongated mating member in at least one second angular position of the plunger.

14. The connection system according to claim 9, wherein the elastic member is an axially split ring configured to be retracted into a circumferential groove running around the second elongated mating member, the elastic member comprising a frustoconical surface facing the first elongated mating member and converging toward the first elongated mating member.

15. The connection system according to claim 14, wherein the hollow tube has an inside diameter which is equal to at least one diameter of the frustoconical surface of the ring other than the maximum diameter of the frustoconical surface.

16. The connection system according to claim 15, wherein the plunger comprises a one-piece part including a hollow tube portion defining the actuator and including at least one axial portion provided with a circumferential groove receiving a retaining elastic ring positioned radially outside the hollow tube portion.

* * * * *